US005735429A

United States Patent [19]

Whitworth

[11] Patent Number: 5,735,429

[45] Date of Patent: Apr. 7, 1998

[54] CONTAINER FOR BULK FREE FLOWING MATERIAL

[75] Inventor: James R. Whitworth, Sheperdsville, Ky.

[73] Assignee: Willamette Industries, Inc., Portland, Oreg.

[21] Appl. No.: 559,279

[22] Filed: Nov. 15, 1995

[51] Int. Cl.[6] ..... B65D 5/56

[52] U.S. Cl. ..... 220/416; 220/410; 220/462; 220/465

[58] Field of Search ..... 220/408, 410, 220/416, 418, 441, 462, 465; 229/23 R, 23 A; 222/105, 107

[56] References Cited

U.S. PATENT DOCUMENTS

| | | | |
|---|---|---|---|
| Re. 33,128 | 12/1989 | Nordstrom . | |
| 1,821,307 | 9/1931 | Howland | 229/23 A |
| 2,819,008 | 1/1958 | White et al. . | |
| 2,932,438 | 4/1960 | Smith . | |
| 2,946,494 | 7/1960 | Kuss . | |
| 2,973,119 | 1/1961 | Parker . | |
| 3,108,732 | 10/1963 | Curie et al. . | |
| 3,139,227 | 6/1964 | Dorfman . | |
| 3,204,849 | 9/1965 | Vinney . | |
| 3,206,094 | 9/1965 | Humphrey et al. . | |
| 3,880,341 | 4/1975 | Bamburg et al. . | |
| 3,952,940 | 4/1976 | Malcolm . | |
| 4,089,417 | 5/1978 | Osborne . | |
| 4,260,071 | 4/1981 | Bamburg et al. . | |
| 4,706,809 | 11/1987 | Halsell . | |
| 4,742,951 | 5/1988 | Kelly et al. | 220/408 |
| 4,771,917 | 9/1988 | Heaps, Jr. et al. . | |
| 4,793,507 | 12/1988 | Delplanque . | |
| 4,815,631 | 3/1989 | Eeg et al. . | |
| 4,834,255 | 5/1989 | Boots . | |
| 4,850,506 | 7/1989 | Heaps, Jr. et al. . | |
| 4,890,787 | 1/1990 | Liebel . | |
| 4,901,885 | 2/1990 | Boots . | |
| 4,927,037 | 5/1990 | Boots . | |
| 5,050,775 | 9/1991 | Marquardt . | |
| 5,052,579 | 10/1991 | Boots . | |
| 5,069,359 | 12/1991 | Liebel . | |
| 5,071,025 | 12/1991 | Boots . | |
| 5,351,849 | 10/1994 | Jagenburg et al. . | |
| 5,437,388 | 8/1995 | Bartelt et al. | 220/410 |

FOREIGN PATENT DOCUMENTS

| | | |
|---|---|---|
| 538727 | 6/1955 | Belgium . |

OTHER PUBLICATIONS

Attachment 1: Boise Cascade Mar. 14, 1991 design sheets.
Attachment 2: Boise Cascade Nov. 13, 1991 design sheets.
Attachment 3: Boise Cascade Jan. 13, 1992 design sheets.
Attachment 4: Boise Cascade Jan. 28, 1992 design sheets.
Attachment 5: Boise Cascade Feb. 4, 1992 design sheets.
Attachment 6: Boise Cascade Mar. 23, 1992 design sheets.
Attachment 7: Boise Cascade Apr. 3, 1992 design sheets.
Attachment 8: Boise Cascade Apr. 21, 1992, design sheets.
Attachment 9: Boise Cascade Jun. 20, 1987 design sheets.

*Primary Examiner*—Gary E. Elkins
*Attorney, Agent, or Firm*—Klarquist, Sparkman, Campbell, Leigh & Whinston, LLP

[57] ABSTRACT

A corrugated fiberboard bulk shipping container for fluent materials has an outer box and an inner box inserted therein. The outer box is rectangular in cross section, and the inner box comprises two sleeves, each in the form of irregular octagons. During assembly of the container, flaps carried on the outermost of the two inner sleeves fold over the opening at one end of the inner sleeve and engage one another to fix the octagonal shape of the inner box. Extended corner portions on the flaps fit substantially into the outer box and stabilize the inner box within the outer box.

11 Claims, 5 Drawing Sheets

10
12
14
16
18
26
28
30
42f
42b
42h
34b
34h
34f
34d
46d
7
73
80h
80d
112
64
66a
66h
72f
66f
66e
84f
x
66b
72b
66d
84b
86h
86d
56a
56h
56f
56e
56b
56d

CONTAINER FOR BULK FREE FLOWING MATERIAL

TECHNICAL FIELD

This invention relates to containers for bulk free flowing material, and more particularly to such containers made of corrugated fiberboard.

BACKGROUND INFORMATION

Fluent materials such as liquids and powders are often shipped in containers that hold bulk quantities of the material. For example, manufacturers of fluid syrups often ship bulk quantities of the syrup from a production facility to another location for repackaging into containers suitable for retail sale. The bulk containers may hold anywhere from a small quantity of the material (i.e., a few gallons or less) to a very large quantity (i.e., several hundred gallons). Because even relatively small quantities of bulk liquids can be very heavy, the containers must be strong and resistant to structural deformity.

The need for a strong container is particularly important during shipping and handling, where the container may be subjected to extreme conditions that stress the container. For example, the container may be subjected to sudden and severe mechanical shock that could damage the container, or cause it to fail. Also, during shipping the container may be exposed to environmental moisture or other contaminants that may tend to weaken the container and put the contents at risk of contamination. Furthermore, during transit the container may be out of the immediate control of the manufacturer that filled it, especially when the container is shipped overseas. For these reasons the container must be strong and able to withstand any foreseeable abuses and environmental conditions without fear of failure.

On the other hand, it is desirable that the container be easily and economically manufactured, light and simple to put together. It is also beneficial to use a container that is easily filled and drained. There is a need, therefore, for bulk containers that possess these desirable qualities while also possessing the requisite structural strength.

Corrugated fiberboard has many advantages for use in bulk shipping containers, and accordingly has been used in many applications for shipping bulk quantities of fluent material. The advantages of using corrugated board as the structural material for bulk containers include its light weight, relatively low cost, and its ability to be reused and recycled. Another advantage of bulk containers made from corrugated board is that they are usually shipped from the manufacturer to the user in a knocked-down condition. The knocked-down containers take up less space and as such more containers may be shipped from the container manufacturer to the user in any one shipment. The user assembles the container on site, adds a liquid-impermeable liner and fills the container with the bulk liquid or other material for shipping.

These advantages notwithstanding, corrugated board generally is not as strong as other materials from which bulk containers are made, such as steel. To overcome this limitation, reinforcement may be necessary to increase the strength of the container. Various methods of reinforcement have been used, such as increasing the number of layers of corrugated board in the container, and adding various reinforcing bands. However, as the strength of a corrugated board container is increased to prevent bulging and deformity, the simplicity and ease of use is generally decreased. For example, the weight of the corrugated board increases as the number of layers increases, and this may make assembly of the container more difficult.

To simplify the process of assembling a knocked-down bulk container it is advantageous to minimize the number of component pieces needed to build the finished container. Unfortunately, bulk containers assembled from corrugated materials often require many different pieces. Given the size of the pieces, which may be quite large and heavy, and thus cumbersome, the finished container may be difficult to erect, especially by one person.

An example of a bulk container made from corrugated board is shown in U.S. Pat. No. 5,351,849, the disclosure of which is incorporated by reference herein. The container disclosed in that patent includes numerous structural components that add to the complexity of assembling the container. Moreover, the components of the container may be unwieldy, especially for one person to handle, thus making assembly difficult. For example, it is difficult for one person to maintain the polygonal shape of the sleeves of the container of this patent while attempting to assemble the components that connect to the sleeves. Thus, while upper plate 12 serves to maintain the polygonal shape of outer sleeve 20 when the container is assembled, actually placing the upper plate onto the outer sleeve may be cumbersome during assembly because the outer sleeve does not hold the desired shape without support until the upper plate is in place. Furthermore, because the drain valve fitment of the container disclosed in this patent is located in a corner void, it is necessary to include a thick base 16 which supports the fluid bladder and which raises the drain fitment upwardly to provide the valve with adequate clearance from the bottom of the container to permit access and draining. This adds more components to the box, adding to its cost and complexity.

There is a need therefore for a bulk liquid container that meets the structural requirements of such a container, yet is light weight, economical, and easy to assemble, handle and use. Specifically, there exists a need for a corrugated bulk container that is light weight and easily set up by one person, yet strong enough to withstand the rigors of shipping and handling without failure.

SUMMARY OF THE INVENTION

The container of the present invention meets these and other needs by providing a corrugated container for fluent materials that is assembled from a minimum number of pieces. The container is light weight and easily erected by one person. It is also strong and easily handled when full.

In one embodiment the invention comprises a container having a rectangular outer box into which a double, octagonal inner box is inserted. A bladder that is impermeable to the fluent material that is to be contained in the container is held within the inner box. The inner box includes as integral component parts thereof a first pair of flaps that fold over either the top or bottom opening to the inner box, or both, and interlock in a cooperative manner to fix the shape of the inner box to facilitate and simplify assembly of the entire container.

As another aspect of the container, the integral first pair of flaps that cover the openings to the inner box and thus protect the filled bladder also serve to stabilize the inner box within the outer box. This is accomplished by providing the flaps with extended portions that, when the flaps are folded over the openings to the inner box, form a platform defining the rectangular shape of the outer box. The platform fits snugly and substantially within the rectangular outer box, and thus serves to guide the inner box into the outer box during insertion of the former therein, and to stabilize the combined boxes.

As another aspect of the container, the first pair of flaps that cooperate to define the shape of the inner box include shoulder portions that interlock with a second pair of flaps during the assembly process. This locks the first set of flaps in a closed position and prevents the inner tube from deforming during the assembly process.

Another advantage of the container of the present invention is that a drain valve fitment of the bladder is retained behind a removable panel formed in one side of the outer box. While shipping bulk material in the container the fitment remains behind the removable panel, where it is protected from contamination. In addition, the sides of the outer box are flush during shipping since there is no valve protruding therethrough. The panel is easily removed to provide access to the fitment for draining.

DESCRIPTION OF THE PREFERRED EMBODIMENTS

Figures 1, 2, 3:
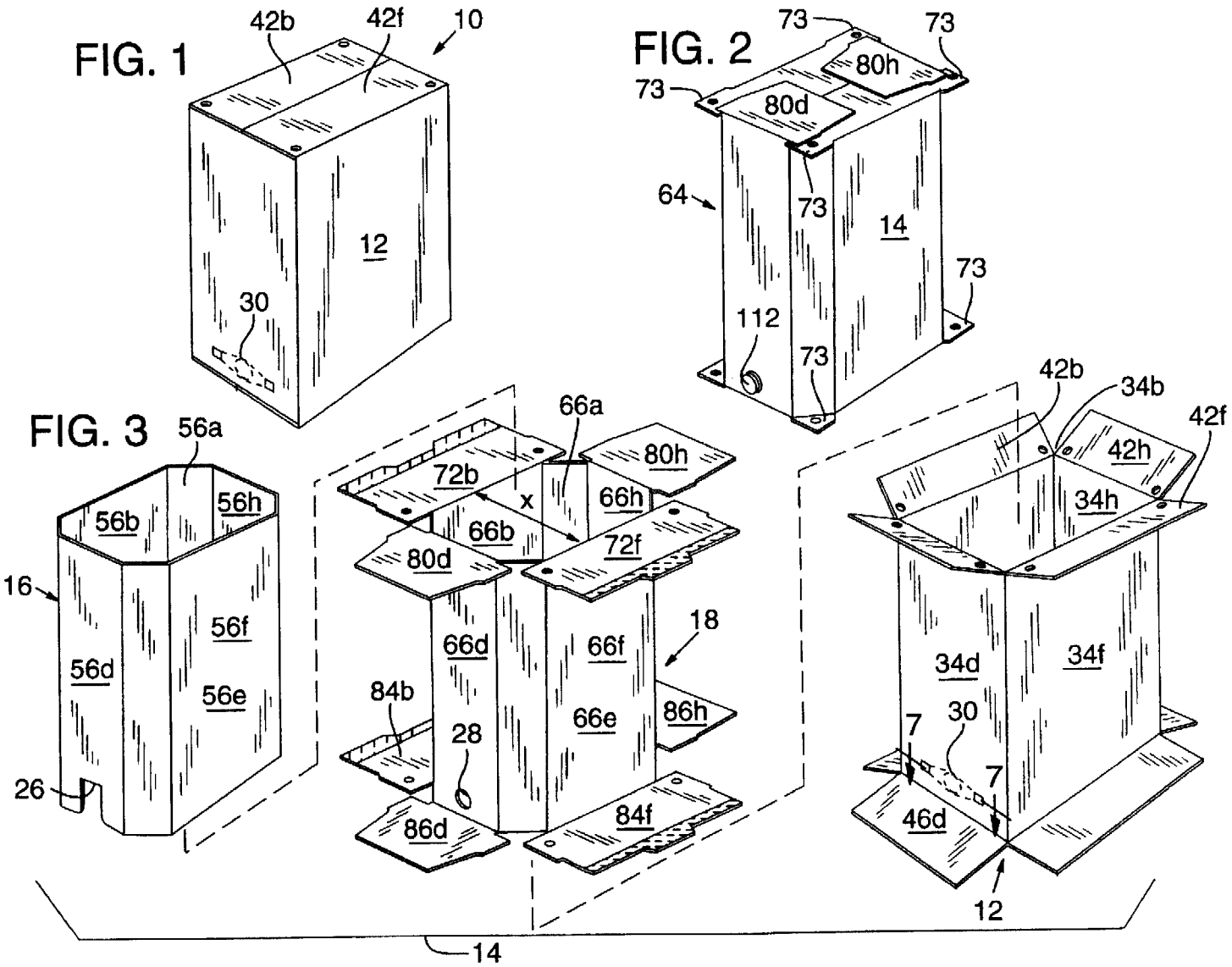
FIG. 1 is a perspective view of a fully assembled container in accordance with a preferred embodiment of the present invention.
FIG. 2 is a perspective view of the assembled inner box of the container, containing a bladder, the fitment of which is shown.
FIG. 3 is an exploded view of the three principal component parts of the container prior to assembly.
Figure 9:
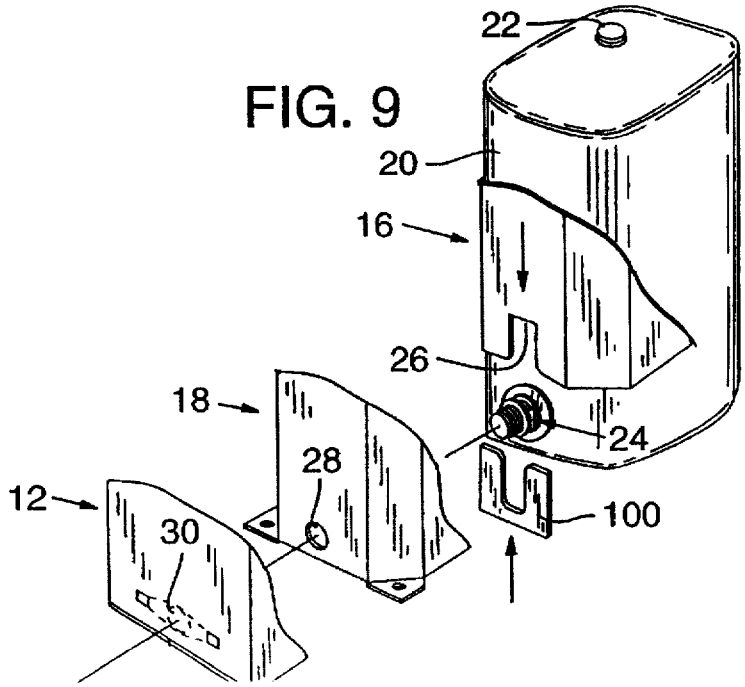
FIG. 9 is a partially exploded view of a portion of the container showing its component parts.

Referring to FIGS. 1 and 2, the bulk liquid container 10 of the present invention includes two primary structural components, an outer rectangular box 12 (FIG. 1) and an inner tube 14 (FIG. 2). As illustrated in FIG. 3, inner tube 14 itself includes two structural components, an interior sleeve 16 and an exterior sleeve 18. Interior sleeve 16 and exterior sleeve 18 have substantially the same cross sectional configuration (in the illustrated embodiment, irregular octagons). Interior sleeve 16 is sized to fit snugly within exterior sleeve 18 when assembled, and the irregular octagon of inner tube 14 is sized to fit snugly within outer box 12. A flexible bladder 20 that is impermeable to the fluid or other free flowing material contained therein, includes an inlet fitment 22 at the upper top end and a discharge fitment 24 at a bottom side, and fits within the hollow interior passageway through interior sleeve 16. (FIG. 9.)

During shipment, the distal end of fitment 24 is retained and hidden behind a removable panel 30 formed in one side panel of outer box 12. The fitment thus remains clean and cannot be damaged or tampered with. When the filled container is ready to be emptied, panel 30 is easily removed to expose fitment 24, which protrudes through a slot 26 formed in a bottom edge of interior sleeve 16 and through a bore 28 formed in exterior sleeve 18.

The corrugated blanks from which the main structural components of the container are assembled will now be described. For clarity, the letter designations used in the Figures in combination with reference numerals are used to indicate panels that are contiguous with one another in the assembled container. As an example, panels assigned a reference numeral followed by the letter "a" are contiguous with one another in the assembled container. Panels assigned a reference numeral followed by the letter "b", also are contiguous, and so on. In addition, as used herein, a "cut line" refers to an incision in the corrugated material that extends completely through the corrugated material, allowing the material to be separated along the incision. A "fold line" on the other hand is formed by crushing the corrugated material on one surface along a linear line. A fold line allows the material to be easily folded along the line. A "score line" is a series of short cut lines interspersed with non-cut sections that allow a piece of corrugated material to be removed by the user. Finally, "interior surface" refers to the surface of a panel that faces the interior portion of the assembled container. "Exterior surface" is the opposite surface of the interior surface.

Figure 4:
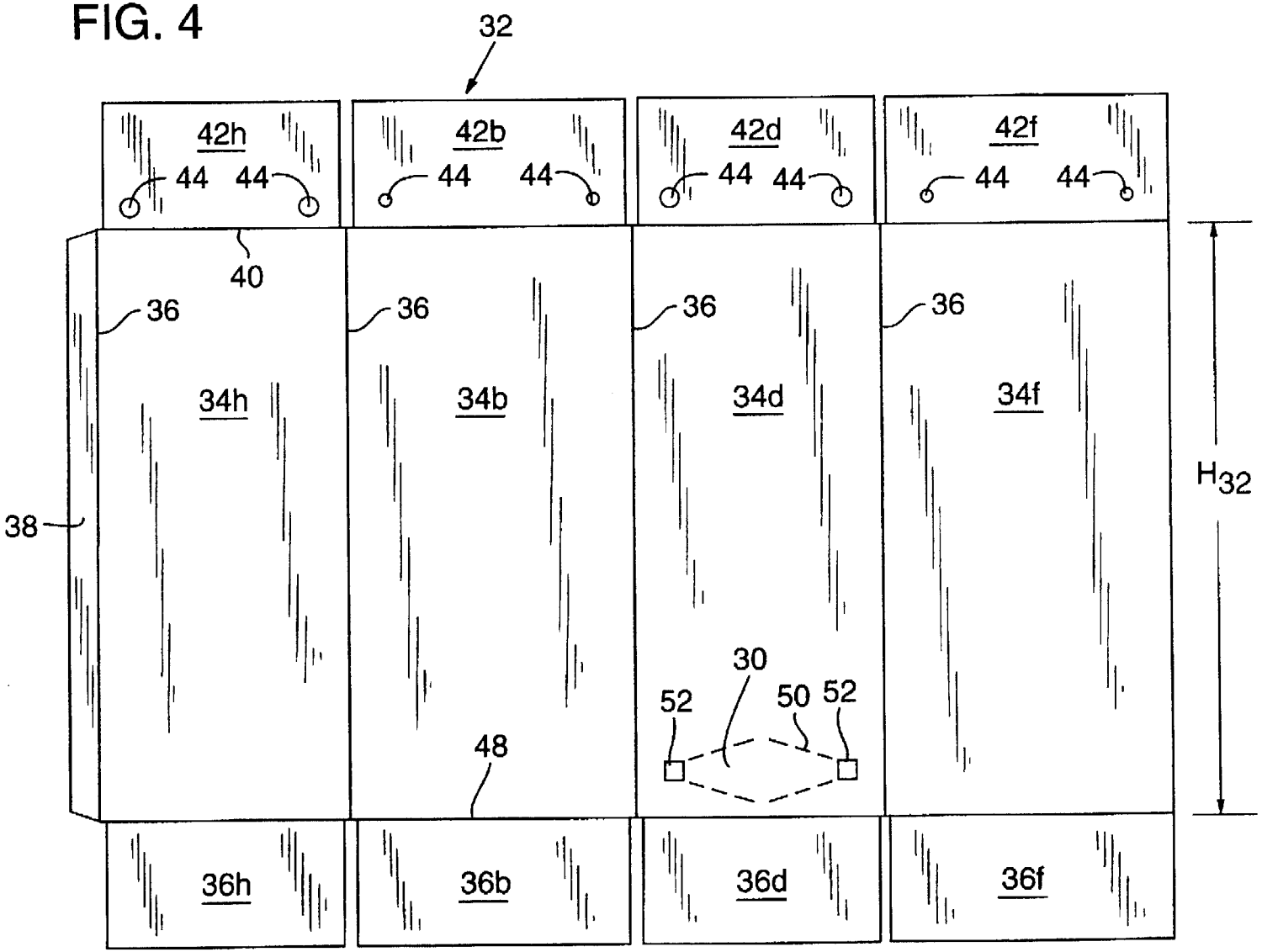
FIG. 4 is a top plan view of a blank that forms the outer box of the container.
Figure 5:
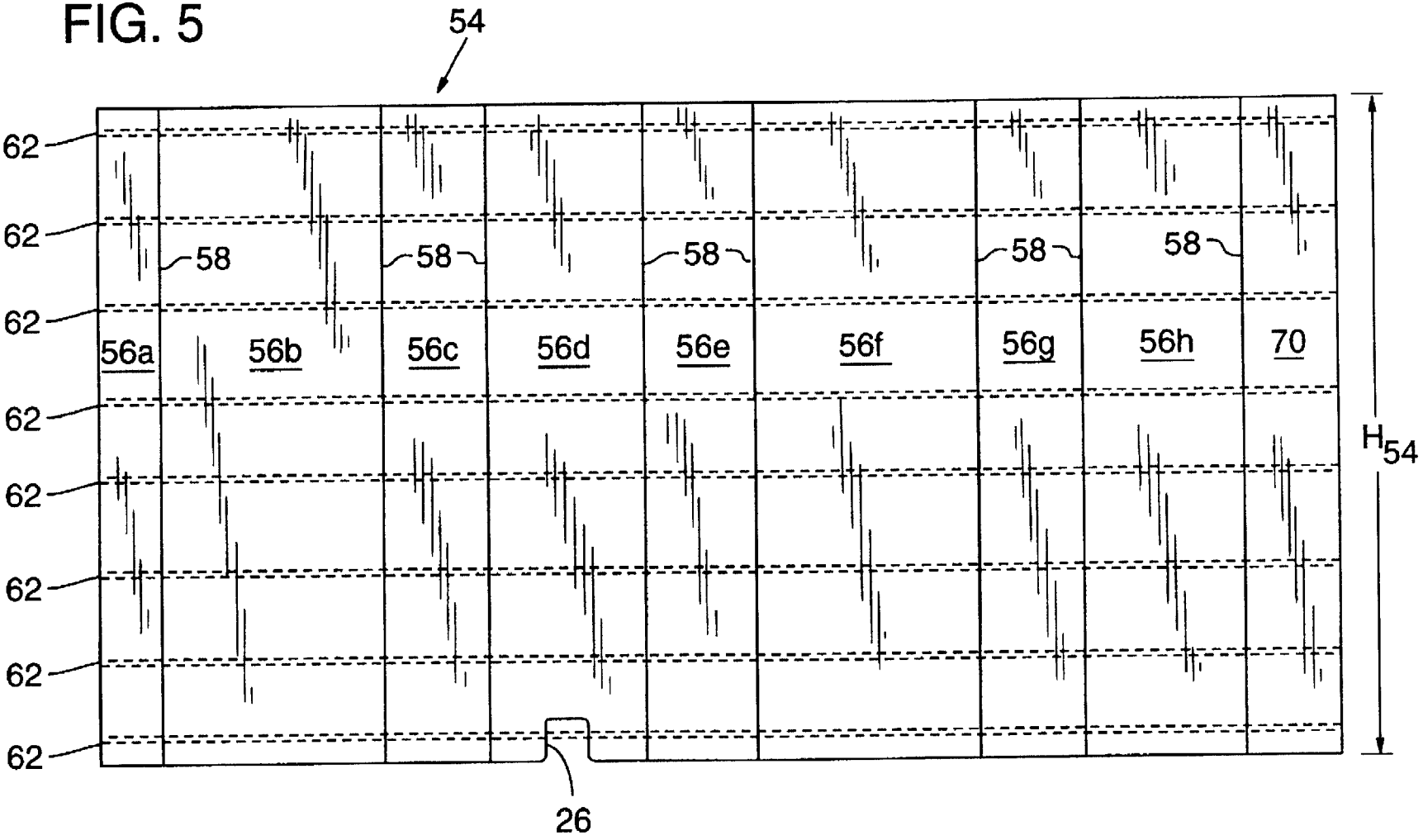
FIG. 5 is a top plan view of a blank that forms the interior sleeve of the inner box of the container.
Figure 6:
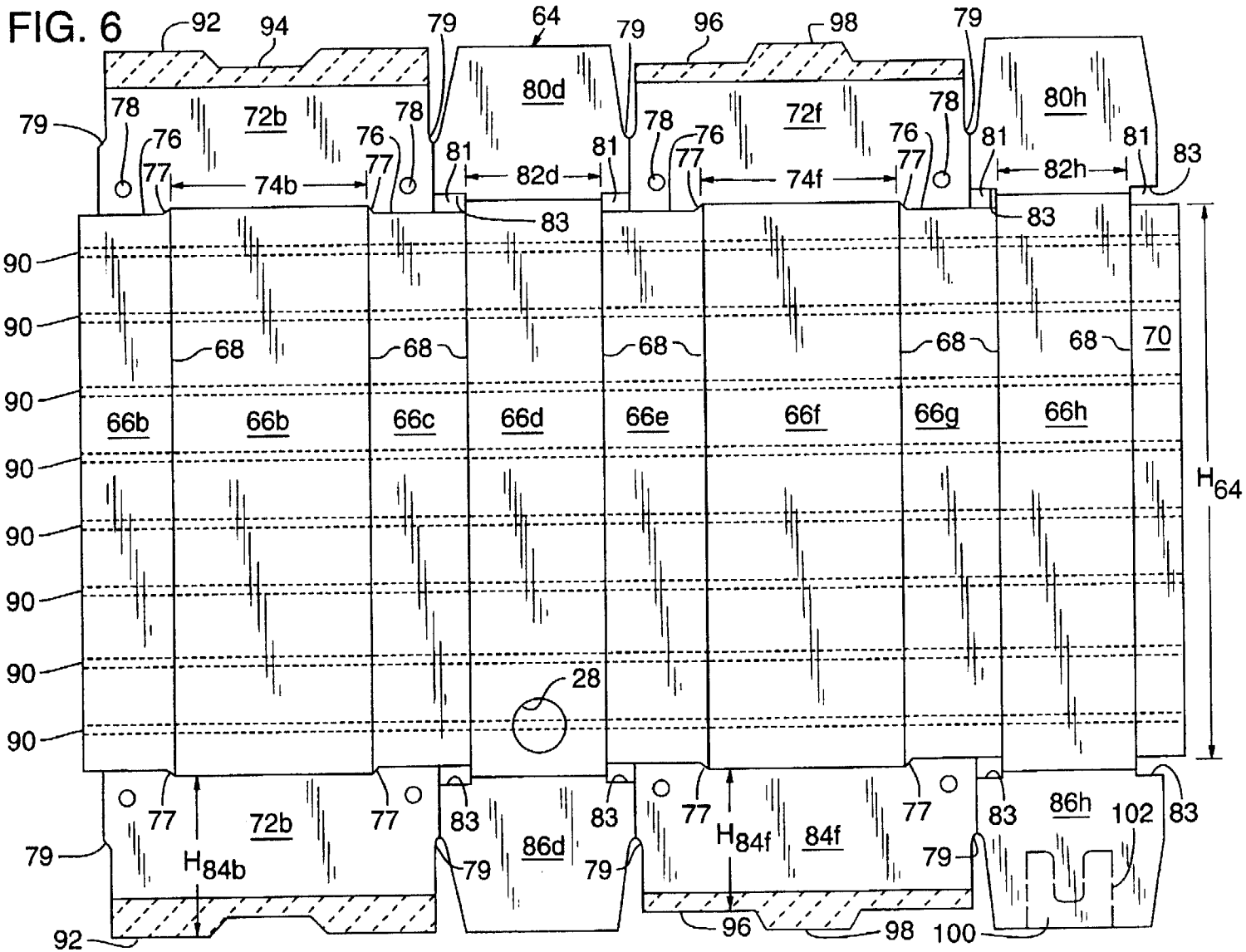
FIG. 6 is a top plan view of a blank that forms the exterior sleeve of the inner box of the container.

The flat corrugated blanks from which outer box 12, interior sleeve 14 and exterior sleeve 18 are constructed are shown in FIGS. 4, 5 and 6, respectively. The illustrated blanks are a single layer of double wall corrugated board. However, multiple layers of corrugated materials could be substituted, as could corrugated board of different weight. This applies to all the corrugated board pieces that are used to assemble container 10.

Outer Box 12

The flat blank 32 from which outer box 12 is constructed is illustrated in FIG. 4. It has four main panels **34*h*, 34*b*, 34*d* and 34*f*, which are separated from one another by fold lines 36. A glue lap panel 38 is separated by a fold line 36 from main panel 34*h*. A top flap is connected to each main panel, and is separated therefrom by a fold line 40. Thus, top flap 42*h* is connected to and extends from main panel 34*h*, top flap 42*b* is connected to and extends from main panel 34*b* and so on. Each top flap includes a pair of bores 44, the purpose of which is explained below. A bottom flap 46 similarly is connected to the opposite side of each main panel from top flaps 42. Each bottom flap is separated from the main panel by a fold line 48**.

A removable panel 30 is formed in main panel **34*d* with score lines 50. A pair of tabs 52** are cut into the outer marginal portions of the removable panel to facilitate removal of the panel as detailed below.

The separate components of container 10 are typically shipped from the box manufacturer to the end user in a flattened, knocked down condition, ready to be erected by the user. By shipping the containers in a flattened condition, many more of the containers may be shipped at one time since less space is taken up by the containers. To prepare outer box 12 for shipping in a knocked down condition, suitable adhesive is applied to the exterior surface of glue lap panel 38 and flattened blank 32 is folded at the fold lines 36 between main panels **34*h* and 34*b*, and main panels 34*d* and 34*f*, respectively, such that the glue lap panel overlaps the interior surface of main panel 34*f*. The overlapped portions are then glued in place. With outer box 12** thus partially assembled, the box will lie substantially flat for shipping.

Inner Tube 14

Interior sleeve 16 of inner tube 14 is assembled from the blank 54 illustrated in FIG. 5. As noted, in the illustrated embodiment the interior sleeve has eight panels, which when assembled form an irregular octagon. However, the number of panels could be varied and the precise number of panels is not critical to present invention. For example, the inner tube may be formed from most any polygonal shape, provided that the number of sides of the polygonal inner tube is greater than the number of sides of the outer box. However, as the number of sides to the polygonal inner tube increases, so generally does the complexity and cost of the container.

Main panels 56*a* through 56*h* are separated from one another by fold lines 58. A glue lap panel 60 is separated by fold line 58 from main panel 56*h*. Plural bands of reinforcing tape 62, such as Sesame™ Tape, available from The H. B. Fuller Company, Linear Products Division, Vancouver, Wash., are applied during manufacture of the corrugated board to an inner wall of the double wall corrugated board. It will be appreciated that the reinforcing tape is not visible in normal use since the tape is on the interior of the corrugated board. However, the reinforcing tape also could be applied to exterior surfaces of the blank. Slot 26 is cut into one marginal edge of main panel 56*d*.

Like outer box 12, interior sleeve 16 is shipped in a flattened condition, ready to be assembled by the end user. Thus, adhesive is applied to a portion of the exterior surface of glue lap panel 60 and blank 54 is folded over on itself at the fold lines 58 between main panels 56*b* and 56*c*, and main panels 56*f* and 56*g*. The adhesive-coated portion of glue lap panel 60 is adhered to main panel 56*a*. In this manner interior sleeve 16 will lie flat during shipping.

The blank 64 from which exterior sleeve 18 is constructed is illustrated in FIG. 6. The eight main panels 66*a* through 66*h* are separated from one another by fold lines 68. A glue lap panel 70 is separated from main panel 66*h* by a fold line 68. A top flap 72*b* is connected to main panel 66*b* at a fold line 74*b* therebetween. Similarly, a top flap 72*f* is connected to main panel 66*f* at a fold line 74*f*. The fold lines 74*b* and 74*f* that connect top flaps 72*b* and 72*f* to the adjacent main panels, 66*b* and 66*f*, respectively, extend across the entire width of the main panels, as illustrated, plus a further distance on each lateral side of the main panels. Top flaps 72*b* and 72*f* therefore extend partially beyond the lateral sides of main panels 66*b* and 66*f* and partially over main panels 66*a* and 66*c*, 66*e* and 66*g*, respectively. In the areas where the top flaps extend partially over main panels 66*a*, 66*c*, 66*e*, and 66*g*, the top flaps are separated from the main panels by a cut line 76, as opposed to a fold line. In addition, near the intersection of fold lines 68 and the outer lateral ends of fold lines 74*b* and 74*f*, a relatively shorter cut line 77 juts angularly from each lateral end of fold lines 74*b*, 74*f* in the direction toward main panels 66 to thereby connect with cut lines 76 and to thus define a shoulder area on main panels 66*b* and 66*f* where top flaps 72*b* and 72*f* are connected thereto.

Bores 78 are formed in each top panel 72*b* and 72*f*.

Top flaps 80*d* and 80*h* are connected to main panels 66*d* and 66*h*, respectively, at fold lines 82*d* and 82*h*, respectively. The fold lines 82*d* and 82*h* that connect top flaps 80*d* and 80*h* to the adjacent main panels, 66*d* and 66*h*, respectively, extend across the entire width of the main panels, as illustrated. Top flaps 80*d* and 80*h* also extend a further distance on each lateral side of the main panels and therefore extend partially beyond the lateral sides of main panels 66*d* and 66*h*. In the areas where the top flaps extend partially over main panels 66*c*, 66*e*, and 66*g* and glue lap panel 70, the top flaps but are separated from the main panels (and the glue lap panel) by a cut out portion 81, the lower edge of which is identified for reference with numeral 83. As illustrated in FIG. 6, main panels 66*d* and 66*h* extend outwardly past cut lines 76. As such, flaps 80*d* and 80*h* are attached to the corresponding main panels at a shoulder area on the main panels adjacent the cut out portions 81.

Bottom panels 84*b*, 84*f*, and bottom panels 86*d* and 86*h* are similarly attached to the respective main panels as detailed above with regard to top flaps, and are structurally identical thereto.

A bore 28 is formed through main panel 66*d*, and plural bands of reinforcing tape 90 extend across blank 64 on the interior surface of a wall panel thereof, as described above with reference to interior sleeve 16. As with the reinforcing tape on interior sleeve 16, the bands could interchangeably be placed on an exterior surface.

The outer free marginal edges 92 of top flap 72*b* and bottom flap 84*b* include a recessed portion 94. The outer marginal edges 96 of top flap 72*f* and bottom flap 84*f* include an extended portion 98. In addition, shoulders 79 are formed on the lateral free side edges of top flaps 72*b* and 72*f*. The purpose and function of recessed portions 94, extended portions 98, and shoulders 79 are described below. The shaded areas in FIG. 6 along the outward marginal edges of top flaps 72*b* and 72*f*, and bottom flaps 84*b* and 84*f* represent areas where the corrugated material may be crushed to provided added strength and rigidity.

A horseshoe-shaped retainer ring 100 is formed in bottom flap 86*h* with score lines 102. The score lines allow retainer ring 100 to be removed easily from the bottom flap when needed during assembly.

Exterior sleeve 18 is prepared for shipping in a manner similar to outer box 12 and inner tube 14. That is, adhesive is applied to the exterior surface of glue lap panel 70 and blank 64 is folded over onto itself at the fold lines 68 between main panels 66*c* and 66*d*, and main panels 66*g* and 66*h*, respectively, so that the glue lap panel is adhered to main panel 66*a*. In this manner, the partially assembled exterior sleeve 18 may lie flat during shipping.

The three primary structural components of container 10, the outer box, interior and exterior sleeves, are shipped to the user in their flattened position, where the container is erected by the user as illustrated in FIG. 3 and as detailed below.

Assembly

Figure 7:
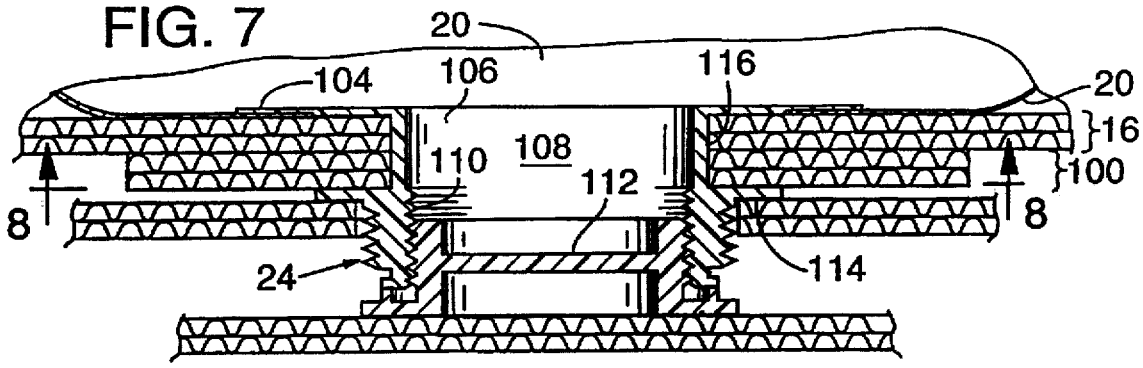
FIG. 7 is a cross-sectional view of through a wall section of the container, approximately along the lines 7—7 of FIGS. 3 and 8.
Figure 8:
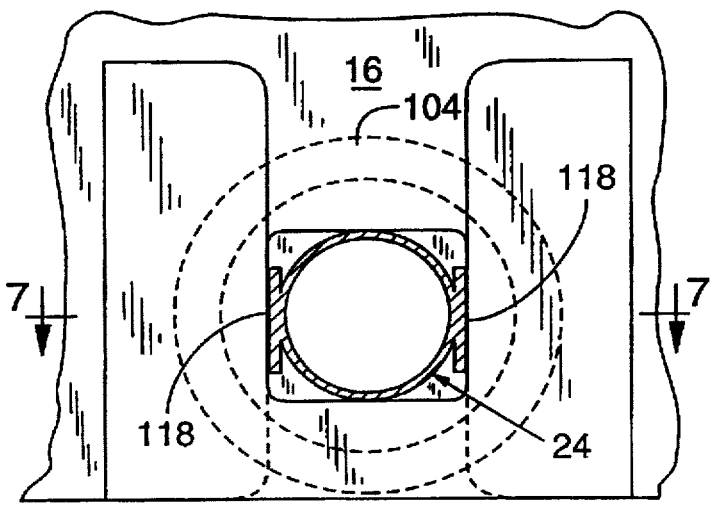
FIG. 8 is a sectional view taken along the line 8—8 of FIG. 7.

The first step in assembling the container is removal of retainer ring 100 from bottom flap 86*h* at score lines 102. Next, each of the three components, interior sleeve 16, exterior sleeve 18 and outer box 12 are unfolded from their flattened shipping positions into a semi-erect state such that the components have interior passageways formed therethrough. Flexible bladder 20 is then inserted into the interior passageway of sleeve 16. Flexible bladder 20 includes a discharge fitment 24, as illustrated in FIGS. 7, 8 and 9. A concentric base 104 is fluidly sealed to bladder 20. A bore 106 defines an interior passageway 108 through fitment 24, through which the contents of the container are eventually drained. During shipment and prior to installation of a drain valve for draining, the bladder 20 completely covers the interior end of passageway 108 and the bladder itself thus forms a fluid seal. The outer distal portion of passageway 108 has an internal threaded portion 110. A plug 112 has complementary external threads for threading into the internal threaded portion 110 of passageway 108. A rigid external collar 114 defines an external throat 116 between base 104 and external collar 114. As illustrated in FIG. 7, fitment 24 is molded or machined in the area of external throat 116 so that the opposite lateral side edges 118 of the external throat define parallel edges.

With the interior sleeve roughly erected into an irregular octagon similar to that shown in FIG. 3, and with flexible bladder 20 inserted into the interior passageway through the internal sleeve 16, discharge fitment 24 is inserted into slot 26 with the parallel lateral side edges 118 of external throat 116 abutting the internal edges of the slot. (FIG. 9.) The fitment is slid into slot 26 until the upper edge of external throat 116 abuts the terminal end of the slot. In this manner, with the parallel lateral side edges 118 of external throat 116 abutting against the interior edges of the slot, and with the upper edge of the throat abutting the terminal end of the slot, the discharge fitment is restrained in the slot, preventing rotation of the fitment within the slot.

Retainer ring 100 also contributes to the prevention of rotation of fitment 24 in slot 26. Retainer ring 100 is inserted from the lower side of discharge fitment 24 in the external throat that is defined between external collar 114 and base 104, externally of interior sleeve 16, such that the opposite upright arm members of the retainer ring abut the parallel lateral side edges 118 of external throat 116. As illustrated in FIG. 8, the combined thickness of retainer ring 100 and interior sleeve 16 is substantially the same as the width of external throat 116. Retainer ring 100 is slid toward fitment 24 until the terminal end portion of the retainer ring between the upright arm members abuts the lower part of the fitment throat. (FIG. 7.) The combination of interior sleeve 16 and retainer ring 100 effectively lock discharge fitment 24 in place and prevent it from rotating.

The assembled interior sleeve and bladder are then inserted into the interior passageway through exterior sleeve 18 with panel **56*d* of interior sleeve 16 contiguous with main panel 66*d* of exterior sleeve 18. Interior sleeve 16 fits snugly within exterior sleeve 18. When fully inserted, bore 28 aligns with slot 26, and thus with the position of discharge fitment 24 and the distal end portion of fitment 24 extends slightly through bore 28**.

The height of interior sleeve 16 ($H_{54}$ in FIG. 5) is slightly less than the height of exterior sleeve 18 ($H_{64}$ in FIG. 6).

At this stage of the assembly process combined inner tube 14 does not hold its shape readily since the corrugated board material is free to fold at various fold lines.

Bottom flaps **84*b* and 84*f* of external sleeve 18 are then folded inwardly over the bottom opening into the interior passageway through the sleeve until marginal edges 96 and 92 abut or engage one another and the outermost end portion of extended portion 98 of flap 84*f* at least partially overlaps the base of recessed portion 94 of flap 84*b*. The flaps are folded over in this manner, with marginal edges 96 and 92** abutting one another, until the flaps completely close the opening into the passageway through the sleeve and thus cover the end opening into the sleeve. The flaps are in a closed position when they lie at approximately right angles to the longitudinal axis through the interior passageway through the sleeve.

The combined width of flaps **84*b* and 84*f* (i.e., widths $H_{84b}+H_{84f}$) is equal to or slightly greater than the width across the passageway through sleeve 18 (dimension "X" in FIG. 3). Outer marginal edges 96 and 92 remain in an abutting relationship as flaps 84*b* and 84*f* are folded into the position in which the passageway through the sleeve is completely closed. Because the combined widths of the flaps is equal to or greater than the width across the sleeve, force is exerted between the abutted flaps and is thus exerted outwardly through the flaps and is transmitted to main panels 66*b* and 66*f*. This force causes the irregular octagonal shape of the combined inner tube assembly to assume and be locked into the desired cross sectional configuration. The outer marginal edges 92 and 96** are in an engaging relationship across the lateral width of the flaps. This prevents rotational distortion of the sleeve around the longitudinal axis through the sleeve.

Moreover, when flaps **84*b* and 84*f* are moved into the closed position, shoulders 79 snap into cut out portions 81 of flaps 86*d* and 86*h* such that the lower edges 83 of the cut out portions overlie shoulders 79, preventing the flaps 84*b* and 84*f* from moving out of the closed position (although the flaps may be forcibly moved from the closed position to an open position by lifting the flaps outwardly to disengage the engagement between shoulders 79 and lower edges 83). FIG. 2**. The combination of the outward force exerted on the walls of the sleeve by the closing, abutting flaps, and the interlocking of the shoulders in the cut out portions, effectively locks the irregular octagonal shape of the combined inner tube into shape to define the cross sectional form of the interior passageway.

In the preferred embodiment there is a pair of bottom flaps **86*d* and 86*h*. However, it is not necessary to have two such flaps, as a single flap is sufficient to engage a shoulder 79 and to thereby lock the top flaps 84*b* and 84*f*** in place.

Bottom flaps **86*d* and 86*h* are next folded inwardly over the now-closed bottom flaps 84*b* and 84*f***. The bottom flaps may optionally be taped in place.

Because the octagonal shape is fixed in place by the flaps **84*f* and 84*b*** as described, assembly of the container is greatly simplified and may be easily accomplished by one person.

In the event inner tube 14 is made up of a different number of panels, and assumes a different polygonal shape, the locking mechanism provided by the flaps functions in the same manner, but with a different number of flaps. To this end, the number of interlocking flaps could be greater than two. Furthermore, in some situations it may be desired to utilize only one flap to provide the locking mechanism. In this latter case, the flap would extend across the opening into the tube and engage a cooperating member or portion of the opposite edge of the tube.

With inner tube 14 assembled as described, outer box 12 is erected by folding bottom flaps **46*d* and 46*h* inwardly beneath folded in bottom flaps 46*h* and 46*f***, and sealing the bottom of the outer box with strapping tape or adhesive on the flaps.

As illustrated in FIG. 2, an extended corner tab portion 73 of the folded over top and bottom flaps **72*b*, 72*f*, 84*b* and 84*f* of the assembled inner tube 14 combine to form planar platforms that define a peripheral rectangular edge that is complementary to the shape of the interior of outer box 12. The rectangles formed by the folded over top flaps and bottom flaps are sized to fit snugly within the assembled outer tube. Thus, assembled inner tube 14 illustrated in FIG. 2 is inserted into the interior of semi-assembled outer box 12 with main panel 66*d* of exterior sleeve 18 contiguous with main panel 34*d* of outer box 12. The rectangular platform formed by the closed top and bottom flaps of inner tube 14 slides substantially within the interior of outer box 12 and help stabilize and maintain the structural integrity of the container. The rectangular shape also facilitates and eases assembly. Because the dimensions of the peripheral edge of the rectangle formed by the extended corner portions is slightly greater that the peripheral dimensions of the inner tube (see FIG. 2**), there is a slight space formed between the outer surfaces of the main panels of the inner tube, and the inner surfaces of the outer box.

In the illustrated embodiment, a triangular void is formed in each corner of the assembled container. When the top and bottom flaps 72*b*, 72*f*, 84*b* and 84*f* are folded over into the closed position, the extended corner tab portions of the top and bottom flaps cover the openings to these triangular corner voids.

The height $H_{32}$ of outer box 12 (FIG. 4) is slightly greater than the height $H_{64}$ of exterior sleeve 18, thereby allowing the upper flaps 42*d*, 42*b*, 42*d* and 42*f* to be folded inwardly over the assembled container.

With the container assembled, the bladder may be filled through inlet fitment 22 with a fluid or a free flowing powder. After filling, fitment 22 is closed off with a screw cap and top flaps 72*b* and 72*f* are folded inwardly over the filled bladder in the same manner as described above with reference to bottom flaps 84*b* and 84*f*. Top flaps 80*d* and 80*h* are similarly folded over, as illustrated in FIG. 2. Tape may optionally be used to secure the top flaps in place.

Finally, top flaps 42*d* and 42*h* of outer box 12 are folded inwardly, and flaps 42*f* and 42*h* are folded inwardly over flaps 42*d* and 42*h*, and the flaps are sealed with tape or adhesives.

When assembled, the distal end of discharge fitment 24 is hidden and retained behind removable panel 30, which remains in place, even during shipping, until it is purposefully removed to provide access to the fitment for draining the contents from the container. See FIG. 8. This insures that the fitment remains clean during transit, and is otherwise undamaged and kept free from tampering. Since the discharge fitment is accessed through one side of the rectangular container, a plurality of the containers may be oriented on a shipping pallet with the fitment of each container readily accessible for draining. Furthermore, the position of the fitment on one side of the container permits access to the fitment and draining of the contents without the need for pads to raise the fitment upwardly, as in some prior containers.

When assembled, bores 44 in the top flaps of outer box 12 align with bores 78 of top flaps 72*b* and 72*f* of exterior sleeve 18 to define passageways from the exterior of the closed and sealed container into the triangular voids in the corners of the outer box. Specially equipped dollies or hand trucks with finger-like hooks that insert into these passageways facilitate simple and easy handling of even completely filled containers.

To expose fitment 24 for draining, tabs 52 are grasped and pulled outwardly away from the container. This causes panel 30 to tear out along score lines 50 and separate completely from outer box 12, exposing the distal end of fitment 24, which at this point protrudes slightly beyond the exterior surface of outer box 12 when panel 30 is removed. Plug 112 may then be removed and a drain hose or other drain valve (not shown) may be screwed onto the external threads of the fitment. As the drain valve is screwed onto the fitment, a blade on the drain valve punctures bladder 20 to permit draining.

Various alternative embodiments and additions to the container described above are possible. For example, when additional strength is required, a band of clear reinforcing tape may be added to the external surfaces of outer box 12 and external sleeve 18, centered on the fold lines between the main panels and the top and bottom flaps.

In addition, triangular corner inserts (not shown) may be inserted into each triangular corner void for added strength.

Finally, the surfaces of the corrugated material may be coated with compounds that increase the moisture resistance of the board, such as Michelman 50H coating.

While the present invention has been described in accordance with preferred embodiments, it should be understood that certain substitutions and alterations may be made without departing from the spirit and scope of the claims.

I claim:

1. A container constructed of corrugated fiberboard for containing fluent materials, comprising:

a polygonal tubular outer box;

a polygonal tubular inner box having a greater number of sides than the outer box and disposed within the outer box, the sides of the inner box defining a passageway therethrough;

a first pair of flaps, one flap of said pair connected to one side of the inner box, the other flap of said pair connected to an opposite side of the inner box, each flap of said pair including an outer free marginal edge;

wherein each flap of said pair is foldable over the passageway such that the outer free marginal edge of the first flap of said pair engages the outer free marginal edge of the second flap of said pair when the flaps are folded over the passageway into a closed position, the engaged flaps when in the closed position locking the inner box into a fixed cross sectional shape, each flap of said first pair of flaps also including opposite free side edges, at least one of said opposite free side edges defining a shoulder therealong; and at least one additional flap connected to a side of the inner box and defining an edge that engages said shoulder when said first pair is in the closed position, thereby locking said first pair of flaps in the closed position and preventing said first pair of flaps from moving out of said closed position.

2. The container according to claim 1 wherein the tubular outer box has four side panels and the tubular inner box has four main side panels contiguous with the side panels of the outer box and four secondary panels angularly disposed in relation to the side panels of the outer box to define with the side panels of the outer box plural elongated voids between the secondary panels of the inner box and side panels of the outer box, wherein the sides of the outer box define a rectangular passageway through the outer box, and the first pair of flaps when in the closed position define a platform having a rectangular peripheral edge that is sized to fit within the rectangular passageway through the outer box.

3. The container according to claim 2 including a removable panel near a lower edge of one of said side panels of the outer box, and the inner box has an opening formed in one main side panel that is contiguous with the one said side panel of the outer box having a removable panel, the opening in the main side panel of the inner box in axial alignment with the removable panel.

4. The container according to claim 3 further including a bladder disposed within the inner box, the bladder having a valve fitment disposed through the opening in the inner box, the distal end of the valve fitment disposed behind the removable panel and accessible by removing the panel.

5. A container constructed of corrugated fiberboard for fluent materials, comprising:

an outer box having a plurality of side panels, one of the side panels having a removable panel formed therein;

an inner tube disposed within the outer box, the inner tube having a greater number of side panels than the outer box with one side panel of the inner tube having a valve fitment opening therethrough aligned with the removable panel of the outer box, the inner tube comprising a first sleeve inserted into a second sleeve, the second sleeve having the same number of side panels as the first sleeve, the side panels of the inner tube defining a passageway therethrough having openings at opposite ends thereof;

a first pair of flaps, one flap of said first pair connected to one side of the second sleeve of the inner tube at one end thereof, the other flap of said first pair connected to the opposite side of the second sleeve of the inner tube at the same end as said first flap, each flap of said first pair including a free outer edge, said flaps of said first pair foldable from an open to a closed position to substantially close the opening to said passageway adjacent the flaps, and wherein the free outer edge of the first flap of said first pair engages the free outer edge of the second flap of said first pair when the flaps are in the closed position, each flap of said first pair further including opposite free side edges, at least one of said opposite free side edges defining a shoulder therealong;

a second pair of flaps, one flap of said second pair connected to one side of the second sleeve of the inner tube at one end thereof, the other flap of said second pair connected to the opposite side of the second sleeve of the inner tube at the same end as said first flap, at least one flap of said second pair defining an edge that overlies said shoulder when the first pair of flaps are in the closed position.

6. The container according to claim 5 including a bladder disposed within the passageway, the bladder having a valve fitment disposed in the valve fitment opening in the inner tube and retained behind the removable panel in the side panel of the outer box when the container is shipped, the valve fitment being accessible by removing the removable panel.

7. The container according to claim 5 wherein the first pair of flaps are locked in the closed position when said edge overlies said shoulder.

8. A container constructed of corrugated fiberboard for containing fluent material, comprising:

an outer box having n sides;

an inner box insertable within the outer box, the inner box having greater than n sides, the inner box comprising an inner sleeve disposed substantially within an outer sleeve, the inner and outer sleeves having the same number of sides, the sides of the inner box defining a passageway therethrough having an opening at opposite ends thereof: and means attached to the inner box for fixing the cross sectional shape of the inner box during assembly of the container comprising a first pair of flaps, the first flap of said pair connected to one side of the outer sleeve at one end thereof, and the second flap of said pair connected to the opposite side of the outer sleeve at the same end thereof as said first flap, each flap of said pair foldable over the opening into a closed position wherein the opening to the passageway adjacent said flaps is substantially closed, one flap of said pair including a free outer edge that engages a free outer edge of the second flap of said pair when the flaps are in the closed position, thereby fixing the cross sectional shape of the inner box.

9. The container according to claim 8 wherein the outer box has four side panels and the inner box has four main side panels contiguous with the side panels of the outer box, the inner box further including four secondary panels angularly disposed in relation to the side panels of the outer box to define with the side panels of the outer box plural elongate voids between the secondary panels of the inner box and side panels of the outer box, each of said voids having an opening thereto at opposite ends thereof, and wherein each flap of said first pair of flaps includes two corner tabs which cover one of said openings to an elongate void when the flaps are in the closed position.

10. A corrugated container for holding fluent materials, comprising:

an outer box having plural side panels that define a tubular polygon;

an inner box disposed within the outer box and having main panels contiguous with the side panels of the outer box, and secondary panels angularly disposed in relation to the side panels of the outer box to define with the side panels of the outer box plural elongate voids between the secondary panels of the inner box and side panels of the outer box, each elongate void having an opening thereto at opposite ends thereof, the side panels and secondary panels of the inner box defining a central passageway therethrough, the central passageway having openings at opposite ends thereof;

a pair of flaps, each flap of said pair connected to an opposite main panel of the inner box adjacent one of said openings, the flaps being cooperatively closable over the opening into a closed position, each flap of said pair further including two corner tabs, each of which closes an opening to an elongate void adjacent to the respective corner tab when the flaps are in the closed position, wherein the flaps when in the closed position have a peripheral edge that defines a platform having substantially the same polygonal shape as the outer box, and wherein said platform is contained within said outer box when the container is assembled.

11. In a corrugated container for containing fluent materials, the container being assembled from multiple separate corrugated components including an outer box having four side panels that define a rectangular passageway, an inner box disposed within the outer box and having four main panels contiguous with the four side panels of the outer box, and four secondary panels angularly disposed in relation to the four side panels of the outer box to define with the side panels of the outer box plural elongate voids between the secondary panels of the inner box and side panels of the outer box, the improvement comprising:

a first pair of flaps, one flap of said pair connected to one side of the inner box, the other flap of said pair connected to the opposite side of the inner box, each flap of said pair including a free outer marginal edge, wherein each flap of said pair is foldable over the passageway such that the free outer marginal edge of the first flap of said pair abuts the free outer marginal edge of the second flap of said pair when the flaps are folded over the passageway into a closed position, and wherein the abutted flaps fix the cross sectional shape of the inner box when the flaps are in the closed position, each flap of said first pair of flaps includes opposite free side edges, at least one of said opposite free side edges defining a shoulder therealong; and at least one additional flap defining an edge that engages said shoulder when said first pair is in the closed position, thereby locking said first pair of flaps in the closed position and preventing said first pair of flaps from moving out of said closed position.

* * * * *